US006715227B2

(12) United States Patent
Swain

(10) Patent No.: US 6,715,227 B2
(45) Date of Patent: Apr. 6, 2004

(54) RIFLE PERISCOPE

(75) Inventor: Daniel M. Swain, Southgate, MI (US)

(73) Assignee: Mirror Lite Company, Rockwood, MI (US)

( * ) Notice: Subject to any disclaimer, the term of this patent is extended or adjusted under 35 U.S.C. 154(b) by 0 days.

(21) Appl. No.: 10/210,646

(22) Filed: Aug. 1, 2002

(65) Prior Publication Data

US 2004/0020098 A1 Feb. 5, 2004

(51) Int. Cl.[7] ..... F14G 1/00
(52) U.S. Cl. ..... 42/118; 42/129; 42/143
(58) Field of Search ..... 42/118, 127, 129, 42/143; 359/255

(56) References Cited

U.S. PATENT DOCUMENTS

| | | | | | |
|---|---|---|---|---|---|
| 187,432 | A | * | 2/1877 | Totten | 356/153 |
| 694,904 | A | * | 3/1902 | Youlten | 42/118 |
| 880,378 | A | | 2/1908 | Geis | |
| 1,176,893 | A | | 3/1916 | Hartney | |
| 1,227,544 | A | * | 5/1917 | Lobdell | 356/255 |
| 1,260,285 | A | | 3/1918 | Cordell | |
| 1,264,133 | A | | 4/1918 | Morris | |
| 1,481,294 | A | * | 1/1924 | Luellen | 42/136 |
| 2,331,616 | A | * | 10/1943 | Minghetti | 356/255 |
| 2,391,659 | A | * | 12/1945 | Trafford | 359/403 |
| 2,412,298 | A | | 12/1946 | Siazik | |
| 2,627,132 | A | | 2/1953 | Dolgacius | |
| 2,685,814 | A | * | 8/1954 | SLoan | 356/17 |
| 3,262,440 | A | * | 7/1966 | Kuhn | 124/67 |
| 3,339,450 | A | | 9/1967 | Reed | |
| 3,405,469 | A | | 10/1968 | Francois | |
| 3,863,354 | A | | 2/1975 | Karppinen | |
| 4,878,305 | A | | 11/1989 | Gabrielidis | |
| 5,150,528 | A | * | 9/1992 | Shire | 42/129 |
| D398,035 | S | | 9/1998 | Rowe | |
| 6,311,424 | B1 | | 11/2001 | Burke | |
| 6,643,969 | B1 | * | 11/2003 | Avizonis, Jr. | 42/118 |

* cited by examiner

*Primary Examiner*—Michael J. Carone
*Assistant Examiner*—M. Thomson
(74) *Attorney, Agent, or Firm*—Artz & Artz, PC

(57) ABSTRACT

A rifle periscope (30) is provided for allowing an indirect line of vision without obstructing use of existing sight assemblies (18, 20) mounted on a rifle (10). The rifle periscope (30) includes a removable mount assembly (32) attached to a barrel (22) of the rifle (22) so as to allow for an unobstructed direct line of vision when using the sight assemblies (18, 20). The removable mount assembly (32) has a first surface (48) and a second surface (52). The first surface (48) has a viewing mirror (50) attached thereto for to providing a first indirect line of vision that is outside of a firing range of the rifle (10). The second surface (52) has a targeting mirror (54) attached thereto for providing a second indirect line of vision that is within a firing range of said rifle (10).

12 Claims, 4 Drawing Sheets

RIFLE PERISCOPE

TECHNICAL FIELD

The present invention relates generally to rifles, and more particularly to rifle periscopes for attachment to rifles and providing an indirect line of vision.

BACKGROUND OF THE INVENTION

Rifle periscopes are known for providing users with an indirect line of vision for viewing surrounding areas without exposing the users to those areas or any persons within those areas. In addition, the indirect line of vision also allows the users to fire their rifles from protected positions.

Current rifle periscopes are mounted on the rifles in a manner that permits the users to utilize existing sight assemblies integrated within the rifles. A drawback of these rifle periscopes is that they obstruct normal use of the sight assemblies when the users wish to take a direct line of vision ordinarily taken when the users do not have to seek cover. In other words, a part of the periscope may block at least one of the sight assemblies. Furthermore, some rifle periscopes require the simultaneous use of two or more movable mirrors. As a result, the design of the periscope is somewhat complicated thereby increasing manufacturing time and costs associated therewith.

Therefore, it would be desirable to provide a rifle periscope having a simple structure that provides for an indirect line of vision without obstructing the use of existing sight assemblies integrated within the rifle.

SUMMARY OF THE INVENTION

The present invention provides a rifle periscope that allows for an indirect line of vision without obstructing normal use of existing sight assemblies integrated within the rifle.

The rifle periscope includes a removable mount assembly for attachment to the barrel of a rifle in a manner that allows for an unobstructed direct line of vision when using the sight assemblies. The removable mount assembly has a first surface and a second surface. The first surface has a viewing mirror attached thereto for providing an indirect line of vision that is outside of a firing range of the rifle. The second surface has a targeting mirror attached thereto for providing an indirect line of vision that is within a firing range of the rifle.

One advantage of the present invention is that a user may view the surrounding area from a protected position without exposing himself to any threats within the viewed area.

Another advantage of the present invention is that a user may fire his rifle from a protected position without exposing himself to the target or other persons in the surrounding area.

Yet another advantage of the present invention is that the rifle periscope does not obstruct a direct line of vision when making normal use of the sight assemblies integrated within the rifle.

Other advantages of the present invention will become apparent when viewed in light of the detailed description of the preferred embodiment when taken in conjunction with the attached drawings and appended claims.

DESCRIPTION OF THE PREFERRED EMBODIMENT

Figure 1:
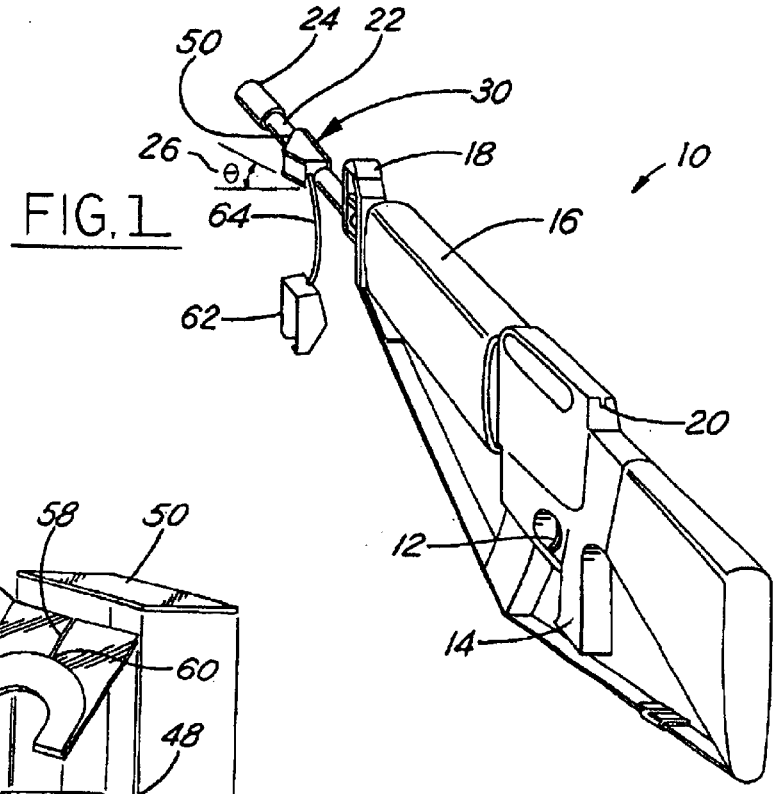
FIG. 1 is a perspective view of a rifle with a rifle periscope mounted thereon, in accordance with a preferred embodiment of the present invention.

In the following figures, the same reference numerals are used to identify the same components in the various views.

Figure 2:
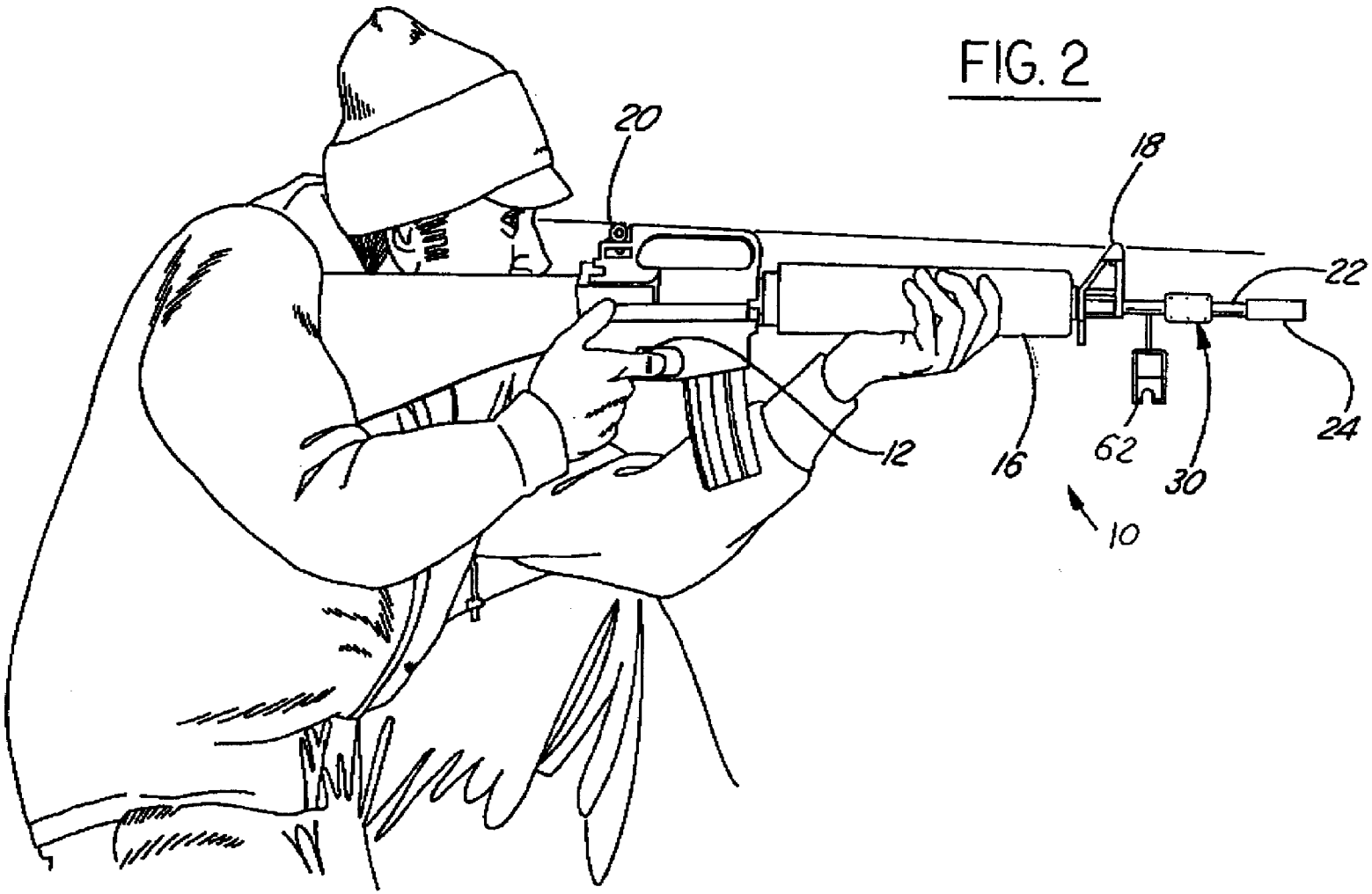
FIG. 2 is a view of an unobstructed direct line of vision taken when using a rifle having a rifle periscope mounted thereon, in accordance with a preferred embodiment of the present invention.

Referring to FIGS. 1 and 2, there are generally shown views of a rifle 10 with a rifle periscope 30 mounted thereon, in accordance with a preferred embodiment of the present invention. The rifle 10 preferably is a military rifle having a trigger 12 adjacent to a pistol grip 14. The pistol grip 14 is intended to provide the user with a handhold for maintaining control of the rifle 10 while he pulls the trigger 12.

The rifle 10 also preferably includes a forestock 16 that is intended to provide a handhold for the user's other hand. Of course, the pistol grip 14 and forestock 16 may be used to handle the rifle 10 in various circumstances other than while firing the rifle 10.

The rifle 10 further includes a front sight assembly 18 and a rear sight windage drum 20 for aiming at a target. The user may aim the rifle 10 by taking a direct line of vision with the front sight assembly 18 and the rear sight windage drum 20. In other words, the user may align the front sight assembly 18 with the rear sight windage drum 20 on the desired target.

The rifle 10 has a barrel 22 that directs rounds of ammunition when they are fired from the rifle 10. As best shown in FIG. 2, the rifle periscope 30 is mounted on a portion of the barrel 22 in manner that does not obstruct a direct line of vision taken with the front sight assembly 18 and the rear windage drum 20. In particular, the rifle periscope 30 is preferably mounted on the barrel 22 between the front sight assembly 18 and a flash suppressor 24 of the rifle 10. However, it is understood that the rifle periscope 30 may be secured to other suitable portions of the rifle 10 that allow the user to view and fire the rifle 10 from protected positions.

Although FIGS. 1 and 2 show a military rifle, it is understood that the rifle periscope 30 may be used for various other types of rifles.

Figure 3B:
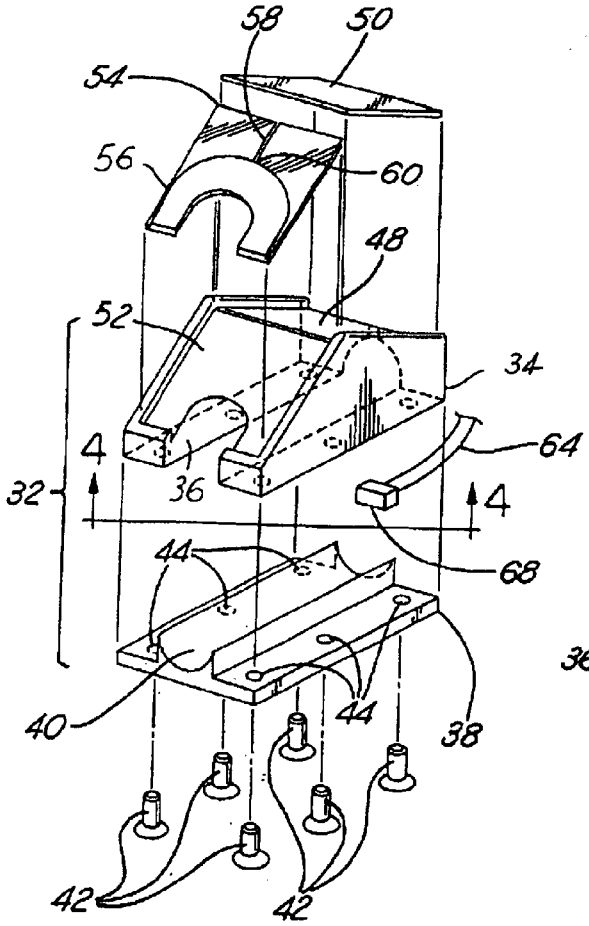
FIG. 3B is an exploded view of a rifle periscope, in accordance with a preferred embodiment of the present invention.
Figure 3A:
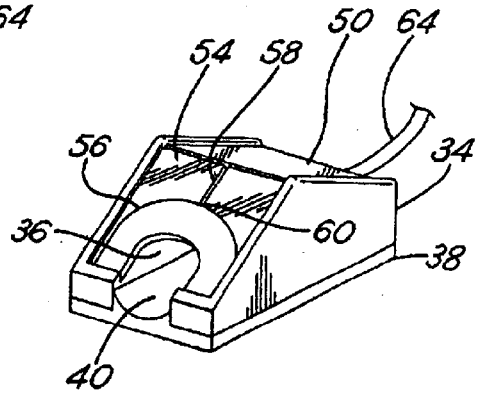
FIG. 3A is a perspective view of a rifle periscope, in accordance with a preferred embodiment of the present invention.

Referring primarily to FIGS. 3A and 3B, there are shown, respectively, a perspective view and an exploded view of the rifle periscope 30, in accordance with a preferred embodiment of the present invention. The rifle periscope 30 includes a removable mount assembly 32 for attachment to the barrel 22 of the rifle 10.

Figure 4:
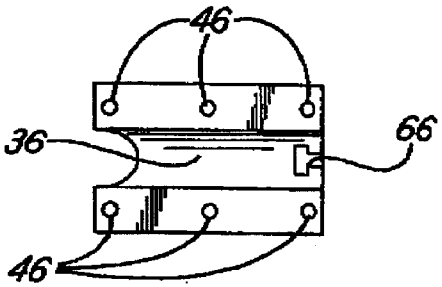
FIG. 4 is a bottom plan view of a mirror base, in accordance with a preferred embodiment of the present invention.

In the preferred embodiment, the removable mount assembly 32 includes a mirror base 34 having a curved surface 36 (as best shown in FIG. 4) for mating to the bare 22 of the rifle 10. The removable mount assembly 32 preferably also includes a backing plate 38 that has an opposing curved surface 40 for mating to the barrel 22. The mirror base 34 and the backing plate 38 preferably are both comprised of aluminum. However, it is understood that the mirror base 34 and/or the backing plate 38 can instead be made of plastic, nylon, rubber or a variety of other suitable materials.

Preferably, the removable mount assembly 32 is secured to the barrel 22 by attaching the backing plate 38 to the mirror base 34 in a manner that clamps the barrel 22 between the curved surface 36 of the mirror base 34 and the opposing curved surface 40 of the backing plate 38.

The backing plate 38 is preferably engaged to the mirror base 34 by a plurality of screw fasteners 42. The screw fasteners 42 are inserted through openings 44 formed in the backing plate 38 and thereafter fastened to threaded holes 46 formed in the mirror base 34.

Of course, the rifle periscope 30 may be attached to the barrel 22 of the rifle 10 by a variety of other suitable fasteners. For example, in an alternative embodiment, a snap-fit engagement between the backing plate 38 and the mirror base 34 may allow for easier attachment and detachment of the rifle periscope 30 from the barrel 22. Moreover, a mere strap may be used to secure the rifle periscope 30 to the barrel 22. It is understood that various other fasteners may be used to attach the rifle periscope 30 to the barrel 22.

Figure 5:
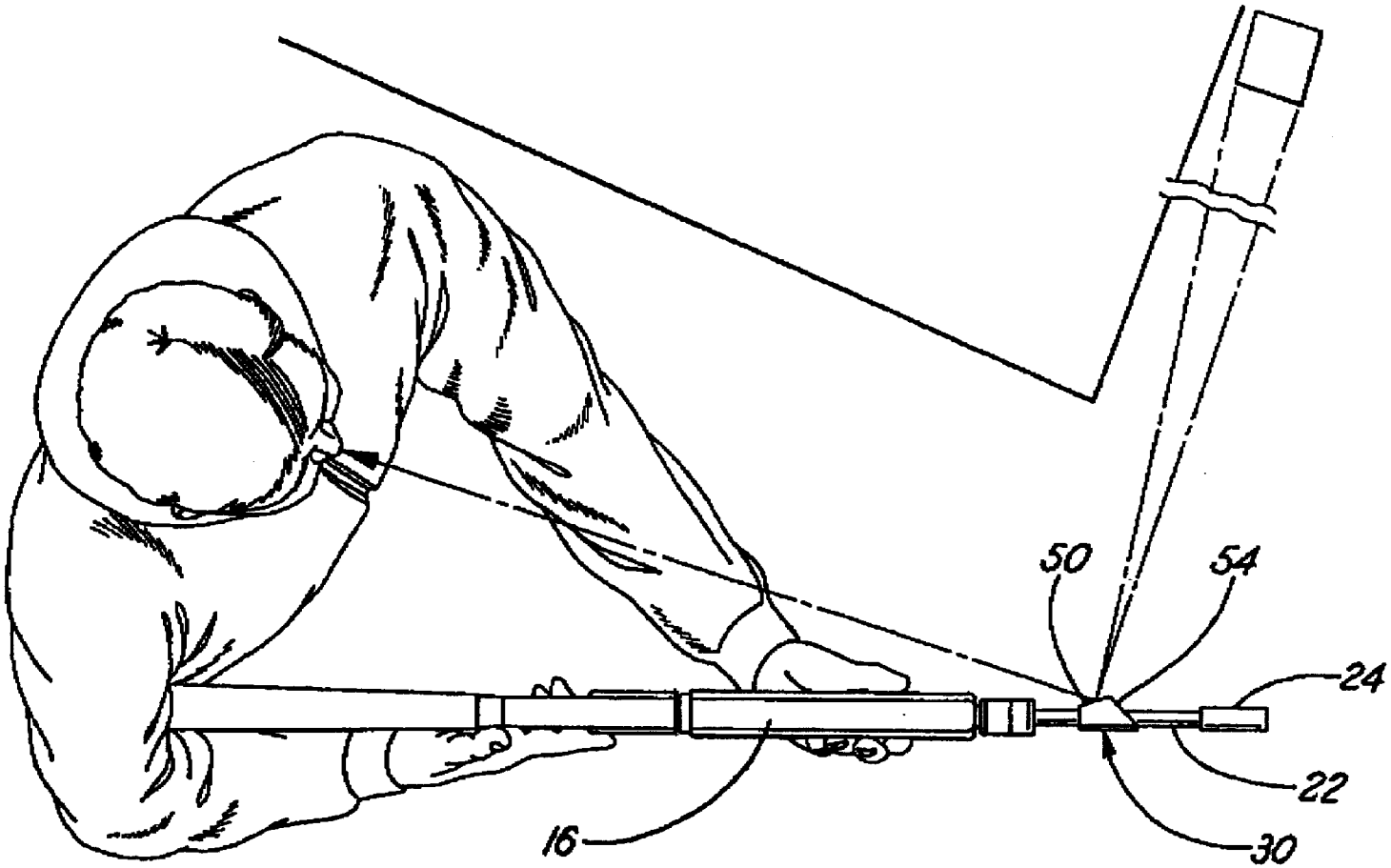
FIG. 5 is a top view of a rifle periscope being used to view a target, in accordance with a preferred embodiment of the present invention.

The mirror base 34 preferably has a first surface 48 intended to receive a viewing mirror 50. As best shown in FIG. 5, the viewing mirror 50 is positioned in a manner that provides the user with an indirect line of vision for safely viewing objects that are beyond a firing range of the rifle 10. The viewing mirror 50 may be made of aluminum, plastic, or other suitable materials that provide sufficient reflection.

Furthermore, the rifle periscope 30 may be rotated about a longitudinal axis of the barrel 22 thereby permitting the user to employ the rifle periscope 12 for viewing surrounding areas in various circumstances. In this regard, the rifle periscope 30 may be rotated at an angle 26 from the horizon (as shown in FIG. 1). There are at least two situations in which the user may wish to rotate the rifle periscope 30.

First, the user may wish to have an indirect line of vision for viewing surrounding areas at a similar height level as the user's eyes. For example, a user holding the rifle 10 near eye level may only need to rotate the rifle periscope 30 a relatively small angle from the horizon. In contrast, a user holding the rifle near waist level may need to rotate the rifle periscope at a larger angle from the horizon.

In another situation, the user may rotate the rifle periscope 30 at various angles for viewing above or below the level of his eyes. For example, a user may rotate the rifle periscope at a relatively large angle to have an indirect line of vision for viewing an object or person located uphill.

Figure 6:
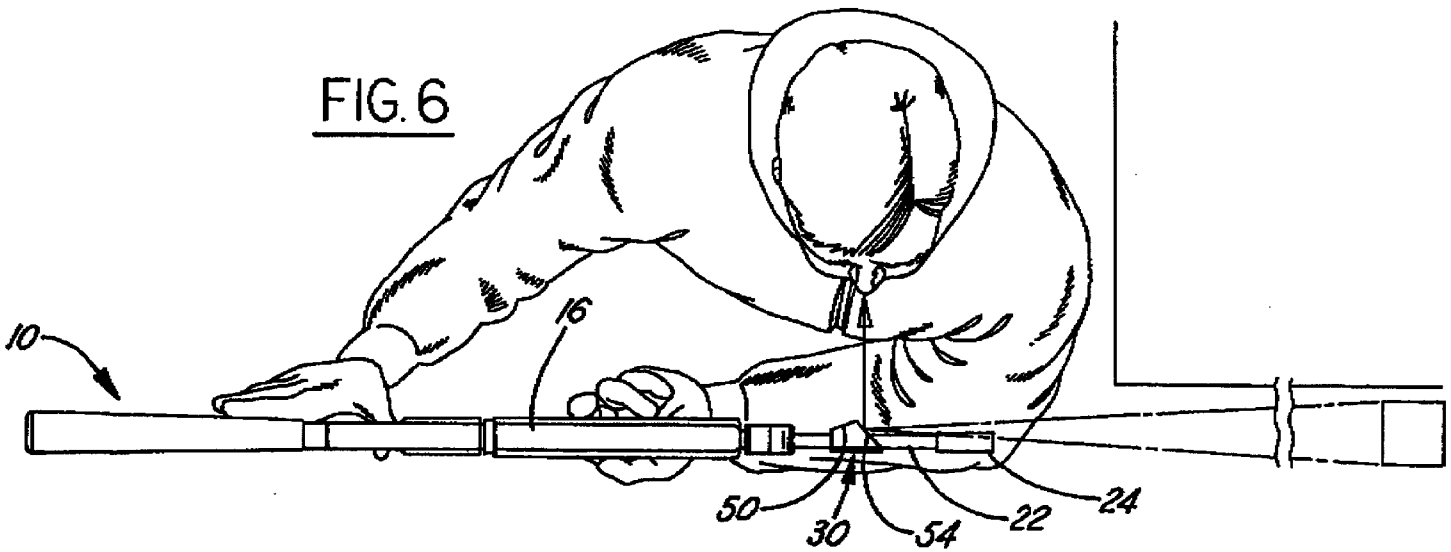
FIG. 6 is a top view of a rifle periscope being used to fire at a target, in accordance with a preferred embodiment of the present invention.

Referring to FIGS. 3A, 3B, and 6, the mirror base 34 also includes a second surface 52 intended to receive a targeting mirror 54. The targeting mirror 54 is positioned on the barrel 22 in a manner that provides the user with an indirect line of vision for aiming and firing at a target. Preferably, the targeting mirror 54 is positioned about 45 degrees from a longitudinal axis of the barrel 22 so as to allow the user to aim and fire the rifle 10 from a side of the rifle 10. Similar to the viewing mirror 50, the targeting mirror 54 may be made of aluminum, plastic, or other suitable materials that provide sufficient reflection.

The targeting mirror 54 preferably has one or more markings for providing the user with a periscope sight. The periscope sight allows the user to aim and fire his rifle 10 at a target from a protected position. These markings preferably include a flash suppressor profile line 56 and a center bore line 58. The flash suppressor profile line 56 and the center bore line 58 intersect at an intersection point 60 intended to serve as the periscope sight.

The user preferably holds the rifle 10 sideways to aim and fire the rifle 10. In particular, the user may hold the forestock 16 in his upwardly facing left palm and grasp the pistol grip 14 with the fingers of his right hand (as shown in FIG. 6).

The user may then utilize the targeting mirror 54 to aim the rifle 10. This is accomplished by positioning the rifle 10 in a manner that allows the user to see that the flash suppressor profile line 56 is outlining the actual profile of the flash suppressor 24. Simultaneously, the user may train the intersection point 60 on the desired target thereby aiming the rifle 10 at that target. The user may then pull the trigger 12 with the thumb on his right hand.

Although this example demonstrates a user holding a rifle 10 for shooting a target positioned to his left, it is understood that the user may utilize a similar technique for shooting a target positioned to his right. Preferably, the intersection point 60 serves as the periscope sight as long as the user sees that the flash suppressor profile line 56 outlines the actual profile of the flash suppressor 24.

Figure 7:
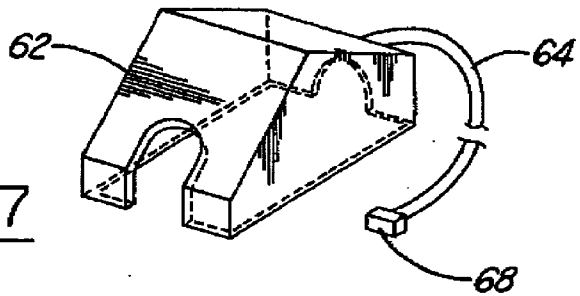
FIG. 7 is a perspective view of a cover for a rifle periscope, in accordance with a preferred embodiment of the present invention.

Referring now to FIG. 7, in the preferred embodiment, the rifle periscope also includes a cover 62 intended to conceal the viewing mirror 50 and the targeting mirror 54 when they are not in use. The cover 62 is preferably secured to the removable mount assembly 32 by a compression fit and alternatively by a snap fit or various other suitable fastening methods.

Furthermore, the cover 62 preferably is attached to the removable mount assembly by a cord 64 so as to dangle the cover 62 therefrom when it is not being used to conceal the viewing mirror 50 and the targeting mirror 54. In particular, the mirror base 34 preferably has a recess 66 formed therein (as best shown in FIG. 4) for receiving an anchor 68 integrated within an end of the cord 64. The anchor 68 is held within the recess 66 when the curved surface 36 of the mirror base 34 is mated to the barrel 22.

While particular embodiments of the invention have been shown and described, numerous variations and alternate embodiments will occur to those skilled in the art. Accordingly, it is intended that the invention be limited only in terms of the appended claims.

What is claimed is:

1. A rifle periscope comprising:

a removable mount assembly attached to a barrel of a rifle so as to allow for an unobstructed direct line of vision when using a sight assembly of said rifle, said removable mount assembly having a first surface and a second surface;

a viewing mirror attached to said first surface, said viewing mirror intended to provide a first indirect line of vision that is outside of a firing range of said rifle; and a targeting mirror attached to said second surface, said targeting mirror intended to provide a second indirect line of vision that is within a firing range of said rifle;

wherein said targeting mirror has a marking thereon intended to provide a periscope sight for firing said rifle, said marking including a flash suppressor profile line and a center bore line that bisects said flash suppressor profile line at an intersection point, said intersection point providing said periscope sight for aiming said rifle.

2. The rifle periscope of claim 1 wherein at least one of said viewing mirror and said targeting mirror is made of a material selected from the group consisting of aluminum and plastic.

3. The rifle periscope of claim 1 wherein said removable mount assembly is made of a material selected from the group consisting of aluminum, plastic, nylon, and rubber.

4. The rifle periscope of claim 1 further comprising a cover that is releasably attached to said removable mount assembly so as to selectively conceal said viewing mirror and said targeting mirror.

5. The rifle periscope of claim 1 wherein said removable mount assembly is rotatably coupled to said barrel of said rifle.

6. A rifle periscope comprising:

a removable mount assembly attached to a barrel of a rifle so as to allow for an unobstructed direct line of vision when using a sight assembly of said rifle, said removable mount assembly having a first surface and a second surface, said removable mount assembly having a cover attached thereto by a cord, said cord having a first end that is fixedly coupled to said cover and a second end that is coupled to said removable mount assembly, said barrel detaining said second end within a recess formed within said removable mount assembly;

a viewing mirror attached to said first surface, said viewing mirror intended to provide a first indirect line of vision that is outside of a firing range of said rifle; and a targeting mirror attached to said second surface, said targeting mirror having a marking thereon intended to provide a periscope sight for a second indirect line of vision that is within a firing range of said rifle said marking including a flash suppressor profile line and a center bore line that bisects said flash suppressor profile line at an intersection point, said intersection point providing said periscope sight for aiming said rifle;

wherein said targeting mirror has a marking thereon intended to provide a periscope sight for firing said rifle, said marking including a flash suppressor profile line and a center bore line that bisects said flash suppressor profile line at an intersection point, said intersection point providing said periscope sight for aiming said rifle.

7. The rifle periscope of claim 6 wherein said cover is releasably attached to said removable mount assembly so as to selectively conceal said viewing mirror and said targeting mirror.

8. The rifle periscope of claim 6 wherein said removable mount assembly is rotatably coupled to said barrel of said rifle.

9. The rifle periscope of claim 6 wherein removable mount assembly is made of a material selected from the group consisting of aluminum, plastic, nylon, and rubber.

10. A rifle periscope comprising:

a removable mount assembly attached to a barrel of a rifle so as to allow for an unobstructed direct line of vision when using a sight assembly of said rifle, said removable mount assembly including a mirror base and a backing plate selectively coupled to said mirror base, said mirror base having a first surface, a second surface, and a curved surface intended to mate to said barrel of said rifle, said backing plate having an opposing curved surface intended to mate to said barrel of said rifle, said backing plate attaching to said mirror base thereby clamping said barrel between said curved surface of said mirror base and said opposing curved surface of said backing plate;

a viewing mirror attached to said first surface, said viewing mirror intended to provide a first indirect line of vision that is outside of a firing range of said rifle; and a targeting mirror attached to said second surface, said targeting mirror intended to provide a second indirect line of vision that is within a firing range of said rifle;

wherein said targeting mirror has a marking thereon intended to provide a periscope sight for firing said rifle, said marking including a flash suppressor profile line and a center bore line that bisects said flash suppressor profile line at an intersection point, said intersection point providing said periscope sight for aiming said rifle.

11. The rifle periscope of claim 10 wherein at least one of said mirror base and said backing plate are made of a material selected from the group consisting of aluminum, plastic, nylon, and rubber.

12. The rifle periscope of claim 10 wherein said removable mount assembly is rotatably coupled to said barrel of said rifle.

* * * * *